United States Patent [19]

Schwarz

[11] Patent Number: 5,020,322

[45] Date of Patent: Jun. 4, 1991

[54] ACCUMULATOR BLOW-BACK HYDRAULIC CIRCUIT

[75] Inventor: Robert A. Schwarz, Rockford, Ill.

[73] Assignee: Sundstrand Corporation, Rockford, Ill.

[21] Appl. No.: 268,862

[22] Filed: Nov. 8, 1988

[51] Int. Cl.[5] ..... F15B 1/02; F15B 20/00

[52] U.S. Cl. ..... 60/404; 60/406; 60/413; 91/33

[58] Field of Search ..... 60/404, 405, 406, 413, 60/417, 430, 441; 91/32, 33

[56] References Cited

U.S. PATENT DOCUMENTS

| | | | |
|---|---|---|---|
| 2,804,753 | 9/1957 | Leduc | 91/33 X |
| 3,651,642 | 3/1972 | Bauch et al. | 60/369 |
| 3,662,550 | 5/1972 | Lichtfuss | 60/405 |
| 3,680,311 | 8/1972 | Harbonn et al. | 60/404 |
| 3,898,809 | 8/1975 | Baker | 60/404 |
| 4,065,094 | 12/1977 | Adams | 60/404 X |
| 4,217,968 | 8/1980 | Dezelan | 60/404 X |
| 4,326,558 | 4/1982 | Gage | 60/404 X |
| 4,422,290 | 12/1983 | Huffman | 60/404 |
| 4,476,677 | 10/1984 | Hanshaw | 60/404 X |

*Primary Examiner*—Edward K. Look
*Assistant Examiner*—George Kapsalas
*Attorney, Agent, or Firm*—Antonelli, Terry, Stout & Kraus

[57] ABSTRACT

A blow-back circuit (10) comprising an accumulator (23) to build up system pressure during normal system operation and an accumulator shut-off valve (13) which prevents dissipation of the accumulator pressure during normal operation. Pressurized fluid is supplied to a fluid motor (11) through a direct drive valve (12). A directional control valve (28) is associated with a switching valve (34) and a stop mechanism (31) which mechanically feedbacks the position of a control surface to be blown back during an emergency. When the control surface is in or blown back to the neutral position, the stop mechanism (31) feeds that data back to the directional control valve (28) so that accumulator pressure will not be further delivered to the fluid motor (11) and a brake (14) will be allowed to prevent further movement of the control surface away from the neutral position. As a result, the control surface is moved to its neutral position with great accuracy and no flutter.

20 Claims, 2 Drawing Sheets

ACCUMULATOR BLOW-BACK HYDRAULIC CIRCUIT

BACKGROUND OF THE INVENTION

1. Field of the Invention

The present invention relates to an accumulator blow-back hydraulic circuit and, more particularly, to a hydraulic circuit for assuring proper blow-back of an aircraft flight control surface to a neutral position in the event of failure of the hydraulic circuit. The invention moves the control surface to its neutral position with great accuracy and little flutter while providing a controlled rate of travel. The blow-back circuit allows the use of a geared rotary actuator (GRA) system which provides high stiffness and low backlash at the control surface.

2. Description of the Prior Art

It is known in mechanical actuation systems for aircraft flight control surfaces to have some mechanism for blowing back or backdriving the surfaces under air loading to an aerodynamically neutral panel position. This feature permits an aircraft to continue flight operations until a safe landing is achievable.

However, I have found that the conventional blow-back mechanisms do not sufficiently address a number of concerns among aircraft manufacturers, namely the blow-back rate, the proximity of the control surface panel, and the flutter resistance of the panel after reaching the neutral position. In the past, actuating systems utilized a power-hinge geared rotary actuator to maintain high stiffness and low backlash of the panel for assuring proper control of the surfaces. The GRA system has the disadvantage of a large mechanical power loss, i.e. a relatively low backdriving efficiency, which results in high backdrive loads at the control surfaces. It also typically requires a large overall gear ratio to the hydraulic motor of the power drive unit which amplifies drag loads at the control surfaces. As a result, proper blow-back of control surfaces to a neutral position rapidly, accurately and permanently has been almost impossible to achieve.

In the past, accumulators have been employed to obtain emergency control, particularly in steering systems, upon interruption of the power fluid supply For example, U.S. Pat. No. 4,476,677 shows an oil/gas accumulator in combination with a charge-discharge valve. However, such a system would not be suited for driving control surfaces of an aircraft to a blow-back position while providing high stiffness and low control surface backlash where the surface is locked in its neutral position. Similar systems are shown in U.S. Pat. Nos. 4,422,290; 4,326,558; and 4,217,968.

Another proposal for using accumulators in association with a valve in emergency situations is shown in U.S. Pat. No. 4,065,094. To prevent catastrophic accidents in power generating plants, quick closing of a valve to prevent fluid leakage is provided by active and standby circuit accumulators.

Hydraulic circuits for motor vehicles in which an accumulator is used are known as shown in U.S. Pat. No. 3,898,809. This system uses a fluid actuated brake booster and a pump outlet connected to a steering valve. A valve spool has an end exposed to a working pressure of the brake booster and in response to that working pressure throttles fluid flow from the pump outlet side and maintains the pressure of the pump outlet side at a predetermined pressure differential above the working pressure.

The storage of hydraulic power using accumulators is shown in U.S. Pat. No. 3,680,311. This circuit uses an accumulator, a safety accumulator and a safety distributor in addition to feed pressurized fluid from the main accumulator to a first and second orifices of an operating element. The safety accumulator is connected to the second orifice of the operating element in parallel with a second outlet duct of the main distributor. This arrangement apparently finds particular application in immersed producing or drilling well heads where the installation has to be controlled remotely. This circuitry is not concerned with the problems associated with blow-back.

A stroke-completing mechanism using an accumulator is disclosed in U.S. Pat. Nos. 3,651,642 and 3,225,544. The former patent involves textile machinery and does not have elements in the circuit which could effect blow-back, high stiffness and low backlash. The latter patent involves the use of an accumulator with associated valves to close a gate in a steel mill bin in response to an air pressure interruption.

Insofar as aircraft systems are concerned, U.S. Pat. No. 2,835,460 shows a hydraulic circuit for an aircraft control surface in which a feel simulator is provided in the event of main pressure supply failure. A pressure accumulator and a control valve are associated with a pilot's control jack to give the pilot time to adjust to changed conditions resulting from the emergency, thereby preventing the pilot from exerting excessive pressure upon the control stick. In such a system, there was no concern with driving a fluid motor to a neutral position and thereafter cutting off the motor charge pressure to prevent further control surface movement.

U.S. Pat. No. 2,505,206 discloses a propeller feathering circuit which, similar to the patent discussed in the immediately preceding paragraph, uses an accumulator; in this case the accumulator is permitted by a valve to complete feathering in response to a differential pressure between the accumulator and pump pressures. Here again, such a conventional system does not suggest a circuit for solving problems involved with control surface blow-back.

SUMMARY OF THE INVENTION

The present invention has as a main object the provision of a blow-back circuit which moves a control surface to its neutral position with great accuracy and minimum flutter.

It is yet another object of the present invention to provide blow-back of a control surface at a controlled rate of travel.

It is still another object of the present invention to provide a blow-back circuit which permits a GRA system to be used in order to provide high stiffness and low control surface backlash.

These and other objects and advantages have been achieved by means of a blow-back circuit which utilizes an accumulator which builds up system pressure during normal operation of the system and an accumulator shutoff valve which isolates accumulator pressure from affecting fluid motor performance during normal system operation and permits a supply of pressurized fluid to a fluid motor through a direct drive valve, or electro-hydraulic servovalve, also during normal system operation.

The circuit in accordance with a presently preferred embodiment of the invention can employ a back-up pressure supply in a dual hydraulic system for actuating the accumulator shut-off valve via a dual piston, or, in a more simplified single hydraulic system, the system pressure can be applied directly to a single land piston during normal operation to supply pressurized fluid to the motor.

The blow-back circuit constructed in accordance with the principles of the present invention includes a directional control valve operatively associated with a switching valve and a stop mechanism linkage to bring about operation of the fluid motor to drive the involved control surface by means of the accumulator pressure in the event of a system pressure loss. The accumulator pressure is isolated from the failed hydraulic system by means of the accumulator shut-off valve and a check valve.

The directional control valve is operatively associated with the stop mechanism through a stop mechanism linkage. The stop mechanism is a timing device which provides a mechanical feedback to the directional control valve through the linkage which can be stepped up or stepped down depending upon design considerations of no significance here. The stop mechanism, which can be in the form of a gear system, recognizes when the control surface reaches the opposite ends of its driving operation. Each position of the stop mechanism represents a discrete position of the control surface, including the neutral position, and also represents, through the linkage, a discrete position of the directional control valve such that when the control surface is in its neutral position the directional control valve will prevent the supply of emergency pressure to the fluid motor but will permit the supply of such pressure where the control surface is above or below its neutral position.

BRIEF DESCRIPTION OF THE DRAWINGS

These and other features, objects and advantages of the present invention will become more apparent from the following detailed description when taken in conjunction with the accompanying drawings which schematically show a presently preferred best mode for carrying out the present invention and wherein.

DETAILED DESCRIPTION OF THE PREFERRED EMBODIMENTS

Figure 1:
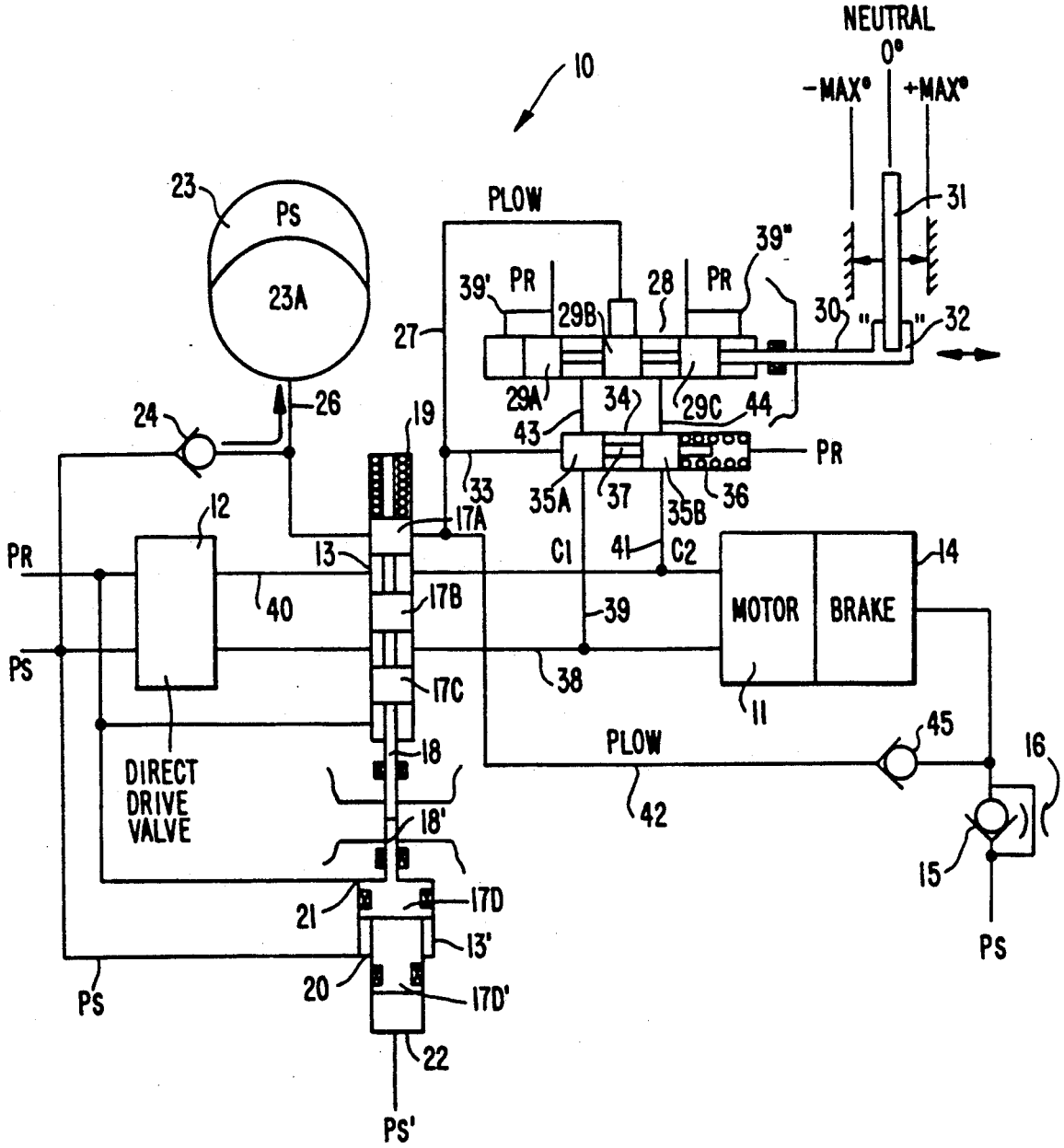
FIG. 1 is a schematic view of the accumulator blow-back hydraulic circuit in accordance with the present invention at a time just prior to failure of the hydraulic system.

Referring now to FIG. 1, the accumulator blow-back hydraulic circuit is designated generally by the reference numeral 10. Since all of the individual parts of the system are conventional, it is sufficient to show these parts in schematic form in order not to obscure the basic features of the invention.

Pressurized primary supply fluid $P_S$ is supplied to a fluid motor 11 for driving a control surface through a direct drive valve or an electro-hydraulic servovalve 12 and an accumulator shut-off valve 13 arranged in series with the motor 11. The supply fluid $P_S$ is also provided to a selectively actuated brake 14 shown adjacent the fluid motor 11 through a check valve 15 which has a restrictor portion 16 bypassing the check valve 15. The restrictor portion 16 does not function during the normal operation of the system but provides for internal leakage which allows the brake line pressure to bleed down when supply pressure is shut-off or is lost due to system failure. Loss of brake line pressure, consequently, causes brake engagement to occur.

In the embodiment shown, the accumulator shut-off valve 13 has a spool stem with 17A,17B,17C slidable in the valve 13 and fixed to a piston rod 18. A compression spring 19 is placed between one end of the accumulator shut-off valve housing and piston 17A in order to normally bias the pistons and associated rod in the downward direction. During normal system operation, the primary supply fluid $P_S$ communicates with the fluid motor 11 and a return fluid $P_R$ is exhausted through the accumulator shut-off valve 13 and the direct drive valve 12 from the motor 11 to establish a working circuit.

Also shown in the illustrated embodiment is an additional piston 13' having a land 14D slidable therein and connected by a rod 18' to the rod 18 of valve 13. Supply fluid $P_S$ is supplied to one side of the piston land 17D at port 20 and return fluid $P_R$ is returned to a sump or the like via a port 21 at the other end of the valve housing. A back-up supply fluid $P'_S$ is communicated to the lower side of the piston land 17D at port 22 to provide a dual hydraulic system which allows the accumulator shut-off valve 13 to be operated by both fluid supply $P_S$ and $P'_S$ against the biasing force of the spring 19.

It will now be readily understood by those skilled in the art that the present invention can be carried out in a single supply pressure system without the need for the dual piston and back-up fluid $P'_S$. In that case, the circuit shown in FIGS. 1 and 2 can be simplified by eliminating land 17D' of piston 13' and by directing the primary supply fluid $P_S$ against the bottom of land 17D to raise the lands 17A,17B,17C against the force of spring 19 and permit the pressurized supply fluid $P_S$ to actuate the motor 11.

The pressurized supply fluid $P_S$ also communicates with an accumulator 23 through a check valve 24. The accumulator 23 in turn communicates through lines 26,42 with the brake 14 as hereinafter described during emergency situations through the accumulator shut-off valve 13 and a check valve 45. During normal operation as shown in FIG. 1, the accumulator receives the pressure supply fluid $P_S$ to build up an accumulator charge pressure in the chamber 23A of the accumulator but is blocked from communicating with the brake 14 by the land 17A which has been moved upwardly against the bias of spring 19 by the primary pressurized fluid $P_S$ or the back-up fluid $P'_S$ (FIG. 1).

Another line 27 branches off from line 42 and communicates with the inlet of a directional control valve 28 which has a spool stem with three lands, 29A,29B,29C slidable therein and rigidly secured to a piston rod 30 which axially reciprocates and which is connected to a stop mechanism 31 through a stop mechanism linkage 32. The stop mechanism 31 is a timing device which feeds back the position of the control surface (not shown) to the directional control valve 28.

Figure 2:
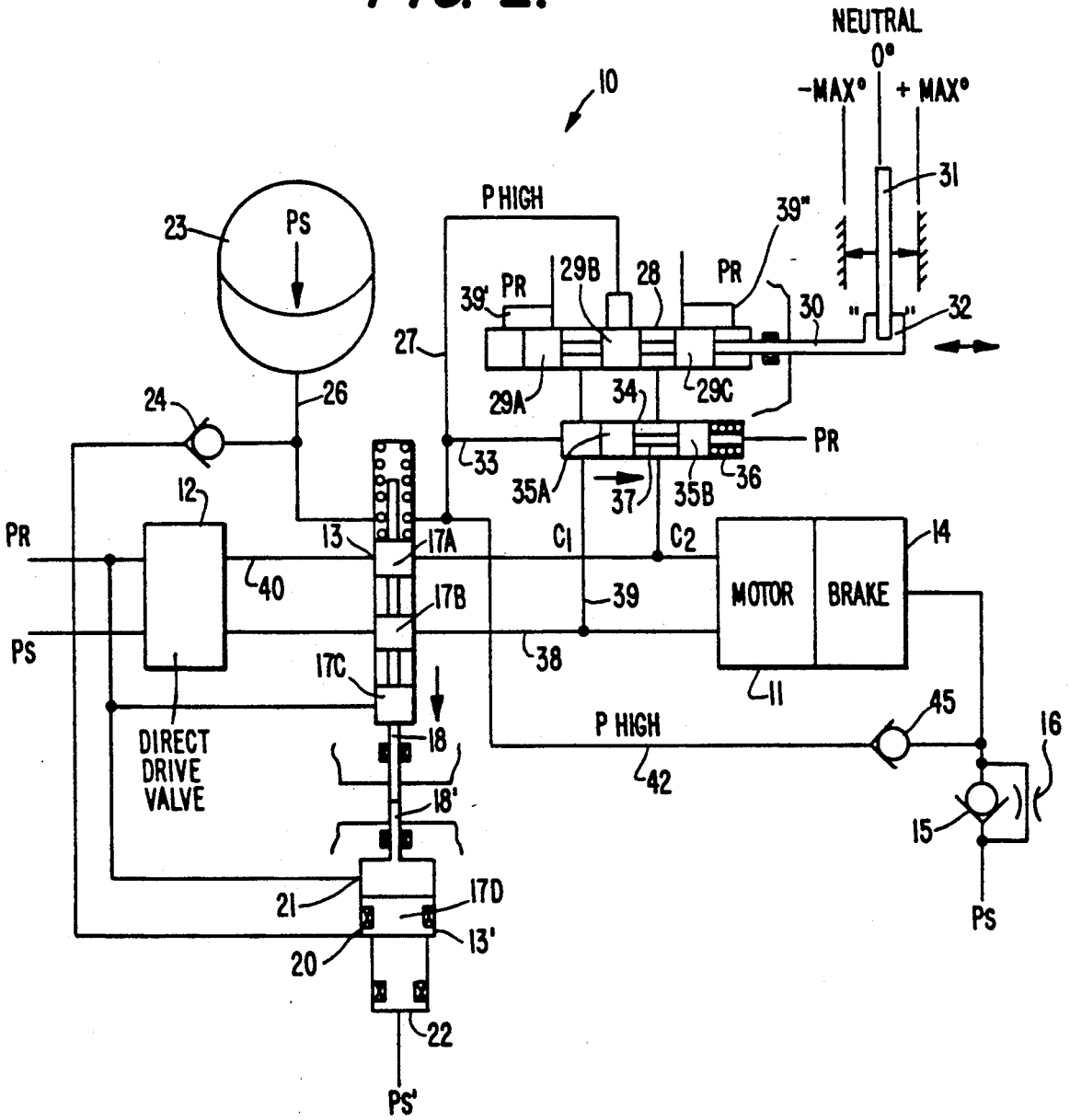
FIG. 2 is a schematic view of the circuit of FIG. 1 after hydraulic power has been lost.

Depending upon the type of linkage 32 employed, sensing of the movement of the stop mechanism by the directional control valve 28 can be increased or decreased (i.e., stepped up or stepped down). Each position of the stop mechanism 31 represents a defined control surface position, including the neutral position, which is correlated to the position of the directional control valve 28. Thus, when the control surface is in the neutral position, the stop mechanism 31 will also be in the neutral position as shown in FIGS. 1 and 2, and in that position the directional control valve 28 will shut off the supply of emergency pressurized fluid from the accumulator 23 but will not block the supply of such fluid when the control surface is not in its neutral position which is capable of maximum degree of movement from the neutral position and designated by "+max°" and "−max°" in FIGS. 1 and 2.

Yet another line 33 branches off from the line 27 to a switching valve 34 which contains a spool stem with two lands 35A,35B defining an annular space therebetween and a compression spring 36 located between an end of the switching valve housing and the face of the land 35B to normally bias leftwardly the lands 35A,35B rigidly connected to a piston rod 37.

A line 38 carrying the pressurized fluid to the fluid motor 11 branches off through line 39 to communicate with a port of the switching valve 34 such that, in the normal system operation, land 35A blocks off line 43 from the interior of the switching valve 34. Likewise, a line 40 carrying the pressure fluid is branched off at 41 to connect with the switching valve housing so as to be normally blocked by the land 35B. The direct drive valve 12 changes $P_S$ and $P_R$ in lines 38 and 40 depending upon motor direction desired. Consequently, the accumulator circuit is isolated from motor during normal operation.

The lands 29A,29B,29C connected by the piston rod 30 define two annular spaces therebetween which can selectively communicate with the line 27 which is shown branched at the housing of the valve 28. The line 27 is normally blocked by the piston 29B and in normal operation, constitutes a low pressure line. Return lines 39',39" for return fluid $P_R$ are also connected with the valve 28 such that the respective return lines associated with pistons 29A,29C are always connected with either the respective right or left faces of the pistons 29A,29C upon movement of the pistons 29A,29B,29C rightwardly or leftwardly as may be necessary upon movement of the control surface transmitted to stop mechanism 31 which shows a "neutral 0°" position.

The normal operation of the circuit 10 will now be described with reference to FIG. 1. Pressurized fluid $P_S$ and $P'_S$ causes the accumulator control valve 13 to move upwardly and block by means of land 17A, accumulator charge fluid in chamber 23A within the accumulator 23 from communicating with the brake 14 through line 42 and with the motor 11 through line 27. If, as previously explained, no back-up pressurized fluid $P'_S$ is to be used for actuating the circuit 10, then the primary pressurized supply fluid $P_S$ only will be communicated with the bottom of the accumulator shut-off valve 13. In either case, pressure is allowed to build up in the chamber 23A of the accumulator 23 where the pressure is stored for later emergency use. At this time, the direct drive valve 12 is in communication with the motor ports so as to operate the motor 11 and associated control surface(s) in the intended manner.

As previously noted, the directional control valve 28 is connected to the stop mechanism 31 for the control surface (not shown) via the stop mechanism linkage 32. The stop mechanism 31 has a degree of movement which corresponds to the degree of maximum movement of the control surface and which also includes a neutral position of the control surface located usually near mid-stroke of the stop mechanism 31. When the control surface reaches a position corresponding to the neutral or null position, the land 29B in the directional control valve 28 is moved relative to a port for line 27 by the stop mechanism linkage 32 to shut off the accumulator control pressure. During normal operation, however, when accumulator control pressure is unavailable, the directional control valve 28 is completely unpressurized and is isolated from the control port pressures $P_S$,$P_R$ of the motor 11 through lines 39,41 by virtue of the switching valve 34 whose pistons 35A,35B are preloaded to the closed position by the compression spring 36. Consequently, movement of the unpressurized directional control valve 28 during normal movements of the control surface 31 will not affect motor performance.

The operation of the circuit in the event of a loss of hydraulic power will now be described by reference to FIG. 2. Regardless of the position of the control surface to be nulled, i.e. moved to the neutral position, at the instant of power loss, the accumulator shut-off valve 13 is moved by the force of spring 19 so that lands 17A,17B close the motor control ports via lines 38,40 and open the line 26 to release accumulator charge pressure to the brake 14 via line 42 and to the fluid motor 11 via the directional control valve 28 and the switching valve 34. However, to prevent the accumulator charge pressure from being lost to failed hydraulic lines, the circuit is isolated by a check valve 24 and the accumulator shut-off valve 13. Thus, the accumulator charge pressure is prevented from dissipating by the check valve 24, and the motor control ports are isolated by the accumulator shut-off valve 13.

In conventional blow-back systems, a failure in the hydraulics will lock the brake 14 immediately, thereby preventing further movement of the affected control surface. In such systems, it is necessary to provide another signal to unlock the brake for continued operation. I have found it possible by virtue of the circuit described and shown herein to release the brake 14 and provide for continued operation of the surface to bring it to the desired blow-back position. This is accomplished by causing the accumulator fluid to pass through the line 33 and force the piston 35A to work against the bias of spring 36 so that fluid can flow from the directional control valve 28 through the switching valve 34 to the motor control ports via lines 39,41 and 38,40, respectively. Accumulator pressure from line 42 releases the brake and allows for motor operation. With the accumulator shut-off valve 13 in open position shown in FIG. 2, accumulator charge pressure can be supplied to the directional control valve 28 and thence to the hydraulic motor 11 for continued operation to return the control surface to a desired blow-back neutral position.

The check valve 15 prevents the accumulator fluid from flushing out the supply line $P_S$, although the restrictor 16 will permit slow dissipation of the fluid around the check valve 15 and by means of the internal leakage cause the brake to engage and lock the surface but only after the surface has been given sufficient time to return to the neutral position. The check valve 45 in line 42 prevents pressurized supply fluid $P_S$ from entering the directional control valve during normal motor operation.

It will be noted that the ports of the directional control valve 28 are located with respect to the stop mechanism 31 such that the motor 11 always drives the control surface back to the neutral position when the directional control valve 28 is off the null position and accumulator charge pressure is acting on the motor. When the control surface is driven back to the neutral position, the stop mechanism 31 and the stop mechanism linkage 32 cause the directional control valve 28 to be brought to the null position, thereby cutting off further accumulator charge pressure to the motor 11. Thereafter, high drag forces resist backdrive of the control surface and also prevent flutter. Subsequently, the charge pressure bleeds off through the restrictor 16, causing the brake 14 to engage and positively lock the control surface in the neutral position.

While I have shown and described at least one preferred embodiment for carrying out the invention, it will be understood that the same is susceptible of numerous changes and modifications without departing from the scope of the invention. Therefore, I do not intend to be limited by the changes shown and described herein but intend to cover all such changes and modifications as are encompassed by the scope of the appended claims.

I claim:

1. A circuit used in a hydraulic system for blowing back an aerodynamic control surface upon the occurrence of a system failure, comprising:

an accumulator in communication with a system pressure to build up system pressure therein during normal operation of the hydraulic system;

motor means for operating the control surface using system pressure during the normal operation;

brake means for selectively braking the motor during the normal operation;

a shut-off valve responsive to one of the system pressure and a back-up system pressure during the normal operation to permit supply of the system pressure to the motor means, the shut-off valve being operatively associated with the accumulator such that, during the normal operation, system pressure built up in the accumulator is prevented from communicating with the remainder of the circuit and during system failure is passed through the shut-off valve;

a directional control valve operatively associated with the shut-off valve so as to be in communication with the built up pressure in the accumulator during system failure and in selective communication with the motor means depending upon displacement of the control surface from a blow-back position; and a switching valve in selective communication with the directional control valve and the motor means and also in communication with the built up pressure in the accumulator during system failure such that the directional control valve and the motor means are in communication depending upon the control surface displacement from the blow-back position.

2. A circuit according to claim 1, wherein a check valve is operatively arranged to isolate the accumulator and to prevent escape of the system pressure built up therein during system failure.

3. A circuit according to claim 1, wherein a valve in the form of a direct drive valve or electro-hydraulic servovalve selectively communicates the system pressure and the motor means to operate the control surface during normal operation of the hydraulic system.

4. A circuit according to claim 1, wherein feedback means is operatively associated between the control surface and the directional control valve for feeding back to the directional control valve the deviation of the control surface from the blow-back position and thereby supplying the built up pressure in the accumulator to the motor means to drive the control surface to the blow-back position in the event of system failure.

5. A circuit according to claim 1, wherein the brake is operatively arranged in the circuit for selectively communicating with the built up pressure in the accumulator during system failure

6. A circuit according to claim 5, wherein a check valve is provided to prevent system pressure supplied to the brake during normal operation of the system from communicating with the directional control valve and the switching valve.

7. A circuit according to claim 5, wherein a check valve and a flow restrictor are arranged in parallel in a line communicating the system pressure to the brake such that the built-up pressure in the accumulator during system failure is forced to escape through the line supplying the system pressure to the brake only through the flow restrictor.

8. A circuit according to claim 1, wherein the shut-off valve includes a spool stem and a spring operatively arranged thereagainst so as to bias the piston toward a position in which the built up pressure in the accumulator communicates with the brake, the directional control valve and the switching means.

9. A circuit according to claim 1, wherein the directional control valve includes three lands arranged such that one land blacks communication with the built up pressure in the accumulator when the control surface is in the blow-back position and the other two lands block communication with respective return lines when the control surface is in the blow-back position.

10. An accumulator blow-back hydraulic circuit for at least one aircraft control surface, comprising means for supplying system pressure to actuate the control surface during normal system operation, and means operatively associated with the system pressure supplying means for supplying emergency pressure such that the control surface is driven back to a neutral position and thereafter locked in that position in the event of failure of the system pressure, wherein said means for supplying emergency pressure includes an accumulator, a shut-off valve selectively communicating system pressure with a motor for actuating the control surface during normal system operation and communicating the accumulator with a directional control valve during failure of the system pressure, and wherein the directional control valve is movable in response to the position of the control surface such that it opens communication between the accumulator and the motor in the case of failure of the system pressure where the control position of the surface is other than the neutral position.

11. A circuit according to claim 10, further comprising a fluid motor and a brake operatively associated with the motor, and wherein said means for supplying the system pressure includes a valve in the form of a direct drive valve or electro-hydraulic servovalve operatively associated with the motor during normal system operation.

12. A circuit according to claim 10, wherein a switching valve is provided between the directional control valve and the motor and arranged such that emergency pressure is provided from the directional control valve to the motor only in the event of failure of the system pressure and isolates the accumulator circuit from the motor during normal operation to prevent degradation of motor performance.

13. A circuit according to claim 10, further comprising a fluid motor and a brake operatively associated with the motor, and wherein said system pressure supplying means includes a valve in the form of a direct drive valve or electro-hydraulic servovalve operatively associated with the fluid motor during normal system operation.

14. A circuit according to claim 13, wherein a check valve is operatively arranged to isolate the accumulator and to prevent escape of the system pressure built up therein in the event of failure of the system pressure supplied to the brake and to the motor through the valve.

15. A circuit according to claim 14, wherein feedback means is operatively associated between the control surface and the directional valve for feeding back to the directional control valve the deviation of the control surface from the neutral position and thereby supplying the built up pressure in the accumulator to the motor to drive the control surface to the neutral position in the event of the failure of the system pressure.

16. A circuit according to claim 15, wherein the brake is operatively arranged for selectively communicating with the built up pressure in the accumulator in the event of the failure of the system pressure.

17. A circuit according to claim 16, wherein a check valve is provided to prevent system pressure supplied to the brake during normal operation of the system from communicating with the directional control valve and the switching valve.

18. A circuit according to claim 17, wherein a check valve and a flow restrictor are arranged in parallel in a line communicating the system pressure to the brake such that built-up pressure from the accumulator during system failure is forced to escape through the line supplying the system pressure to the brake only through the flow restrictor to provide enough time delay prior to brake engagement to allow the motor to drive the control surface back to the neutral position.

19. A circuit according to claim 10, wherein the shut-off valve includes a spool stem and a spring operatively arranged thereagainst so as to bias the spool stem toward a position in which the built up pressure in the accumulator communicates with the brake, the directional control valve and the switching means.

20. A circuit according to claim 19, wherein the directional control valve includes three lands arranged such that one land blocks communication with the built up pressure in the accumulator when the control surface is in the neutral position and the other two pistons block communication with respective return lines when the control surface is in the neutral position.

* * * * *